US011759799B2

(12) United States Patent
Li et al.

(10) Patent No.: US 11,759,799 B2
(45) Date of Patent: Sep. 19, 2023

(54) SHOWER HEAD

(71) Applicant: GLOBE UNION INDUSTRIAL CORP., Taichung (TW)

(72) Inventors: Chun-Hung Li, Taichung (TW); Hui-Ling Chiu, Taichung (TW); Tun-Yao Tsai, Taichung (TW)

(73) Assignee: GLOBE UNION INDUSTRIAL CORP., Taichung (TW)

( * ) Notice: Subject to any disclaimer, the term of this patent is extended or adjusted under 35 U.S.C. 154(b) by 574 days.

(21) Appl. No.: 16/876,590

(22) Filed: May 18, 2020

(65) Prior Publication Data

US 2020/0276596 A1 Sep. 3, 2020

Related U.S. Application Data

(63) Continuation-in-part of application No. 16/055,482, filed on Aug. 6, 2018, now abandoned.

(30) Foreign Application Priority Data

Nov. 16, 2017 (CN) ..... 201721528338

(51) Int. Cl.
*B05B 1/18* (2006.01)
*A47K 3/28* (2006.01)

(52) U.S. Cl.
CPC ..... *B05B 1/185* (2013.01); *A47K 3/281* (2013.01)

(58) Field of Classification Search
CPC ..... B05B 1/14; B05B 1/16; B05B 1/1609; B05B 1/1618; B05B 1/1627; B05B 1/1681; B05B 1/18; B05B 1/185; B05B 15/63; E03C 1/0408; E03C 1/0409; A47K 3/281
See application file for complete search history.

(56) References Cited

U.S. PATENT DOCUMENTS 5,397,064 A * 3/1995 Heitzman ..... B05B 1/185 239/DIG. 12
6,230,988 B1 * 5/2001 Chao ..... B05B 1/1654 239/394
2008/0156902 A1 7/2008 Luettgen et al.
2011/0000983 A1 1/2011 Chang
2013/0239320 A1 * 9/2013 Aihara ..... B05B 1/169 4/615
2017/0157627 A1 * 6/2017 Butzke ..... B05B 1/02
2017/0297039 A1 10/2017 Cacka et al.
2018/0126393 A1 * 5/2018 Wang ..... B05B 1/1618
2019/0091705 A1 * 3/2019 Westgate ..... B05B 1/1681
2020/0222918 A1 * 7/2020 Grigor ..... B05B 1/18

FOREIGN PATENT DOCUMENTS

CN 106269323 A 1/2017

* cited by examiner

*Primary Examiner* — Darren W Gorman

(74) *Attorney, Agent, or Firm* — Browdy and Neimark, PLLC

(57) ABSTRACT

A shower head includes a housing, and a jet faceplate mounted to the housing and including a first water jetting area composed of a plurality of subunits and a second water jetting area having a second jet hole therein. The subunits are arranged to present an arc-shaped distribution, each defining therein a plurality of first jet holes. The subunits are in a fan-shaped area of the jet faceplate so that the water line of the ejected water can be concentrated and fan-shaped, enhancing the effect of removing dirt.

2 Claims, 13 Drawing Sheets

SHOWER HEAD

CROSS-REFERENCE TO RELATED APPLICATION

This application is a continuation-in-part of U.S. patent application Ser. No. 16/055,482, filed Aug. 6, 2018, which is incorporated by reference herein in its entirety.

BACKGROUND OF THE INVENTION

1. Field of the Invention

The present invention relates to the technical field of sanitary products and more particularly, to a shower head.

2. Description of the Related Art

With gradually increasing of people's living standards, people have also increasingly focused on quality of life. In terms of showers alone, people have begun to focus on the overall flow of water sprayed from the shower structure and the water-saving performance during showering. However, in addition to the poor spray water tactile sensation of conventional shower heads available on the market, the water-saving efficiency is greatly reduced due to the splashing of ejected water.

China Patent CN106269323A discloses a shower head entitled: "bundled fine water shower structure", which comprises a housing (1), a jet faceplate (2), and a switching device 4) mounted on the housing (1) for controlling the water spray pattern of the jet faceplate (2). This design is characterized in that the jet faceplate (s 2) comprises a plurality of distributed water outlet units (24) each water outlet unit (24) comprising an equal number of jet holes (241) in circular, oval, pentagonal, triangular or crescent shape, or any other regular or irregular shape, that is, the shape of each outlet unit (24) is surrounded by the same jet holes (241) into a regular or irregular shape and distributed over the jet faceplate (2). In summary, as described above, the "bundled fine water shower structure" achieves the effect of soft touch of jetted water that is not easy to splash as well as the effects of water-saving and applicability in low pressure environment.

However, this design of "bundled fine water shower structure" is not suitable for removing dirt. Under a low-pressure application environment, it cannot concentrate the water line to effectively focus the water line on the dirt. Therefore, the effect of cleaning dirt of this design of shower head is not obvious.

SUMMARY OF THE INVENTION

The present invention has been accomplished under the circumstances in view. It is the main object of the present to provide a shower head, which is aimed to solve the technical problems of the prior art in which the water-saving effect of the shower head is not good.

To achieve this and other objects of the present invention, a shower head comprises a housing, a jet faceplate and a switching device. The housing has one end thereof configured for the connection of a shower tube or a water outlet of a water faucet. The jet faceplate is mounted to an opposite end of the housing, comprising an imaginary center, two imaginary radii extended from the imaginary center point to the periphery thereof for allowing the jet faceplate to be divided into a first fan-shaped region and a second fan-shaped region, a first water jetting area composed of a plurality of subunits, and a second water jetting area. Each subunit comprises a plurality of first jet holes. The second water jetting area comprises a second jet hole. The subunits of the first water jetting area are in the first fan-shaped region. The second water jetting area is in the second fan-shaped region. The switching device is mounted on the housing and operable to switch the water jetting mode of the switching device for causing the original water flowing out from the first water jetting area to be switched to flow out from the second water jetting area.

Preferably, the included angle of the first fan-shaped region formed using said imaginary center and the two imaginary radii is between 90° and 270°; the center of the second jet hole of the second water jetting area is located at the center of gravity of the second fan-shaped region of the jet faceplate.

Preferably, the first jet holes of each subunit are arranged in a radial arrangement or in a line; the aperture of the first jet holes is between 0.8 mm and 1.0 mm.

By means of arranging the subunits in a fan-shaped region of the jet faceplate to present arc-shaped distribution, the water line of the ejected water can be concentrated and fan-shaped, effectively improving the water saving effect of the shower head and the effect of cleaning the dirt Other advantages and features of the present invention will be fully understood by reference to the following specification in conjunction with the accompanying drawings, in which like reference signs denote like elements, components, objects, structures, systems, architectures, means, flows, methods or steps.

DETAILED DESCRIPTION OF THE INVENTION

Figure 1:
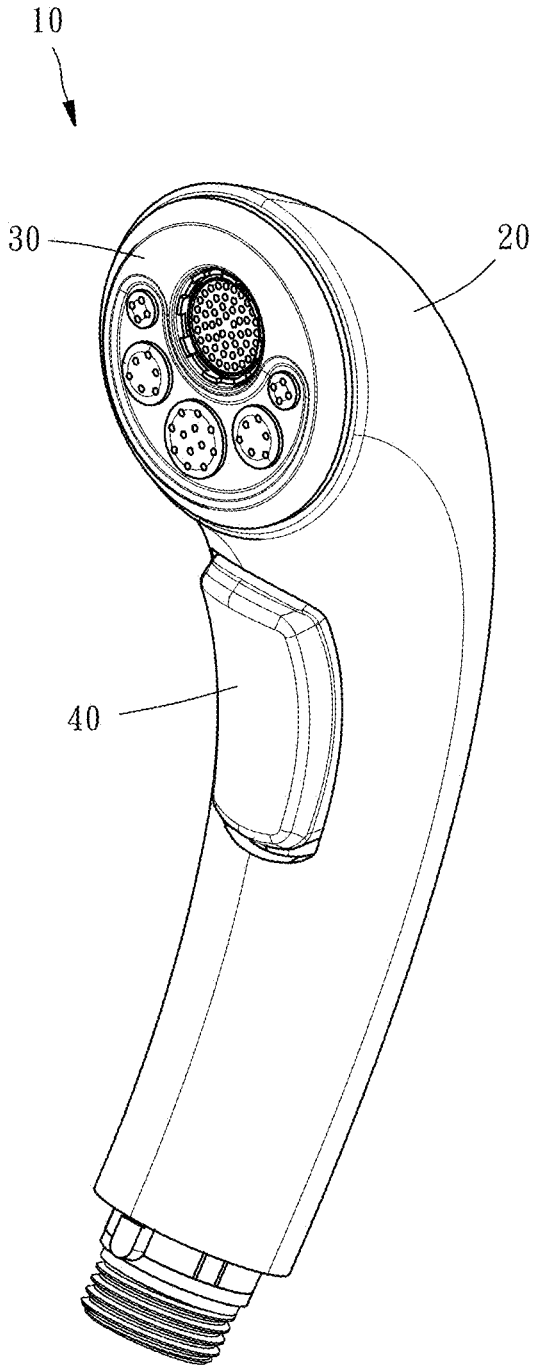
FIG. 1 is a schematic elevational view of a shower head in accordance with a first embodiment of the present invention.

In the description of the present invention with reference to the annexed drawings of FIGS. 1-7, it should be understood that the orientational or positional terms "length", "width", "upper", "lower", "front", "back", "left", "right", "vertical", "horizontal", "top", "bottom", "inner", "outer" and other indications are based on the orientation or positional relationship shown in the drawings, and is merely for convenience of description of the present invention and simplifying the description rather than indicating or implying that the device or component referred to must have a specific orientation or a construction and operation in a particular orientation, it cannot be interpreted as a limitation of the invention.

In the present invention, the terms "mounting," "connecting," "fixing," etc. shall be understood in a broad sense unless specifically defined or limited. For example, it may be a fixed connection, a detachable connection, or an integration; it may be a mechanical connection or an electrical connection; it may be a direct connection or an indirect connection through an intermediate medium and may be an internal connection or interaction between two components. For a person of ordinary skill in the art, the specific meanings of the above terms in the present invention can be understood according to specific conditions.

Figure 2:
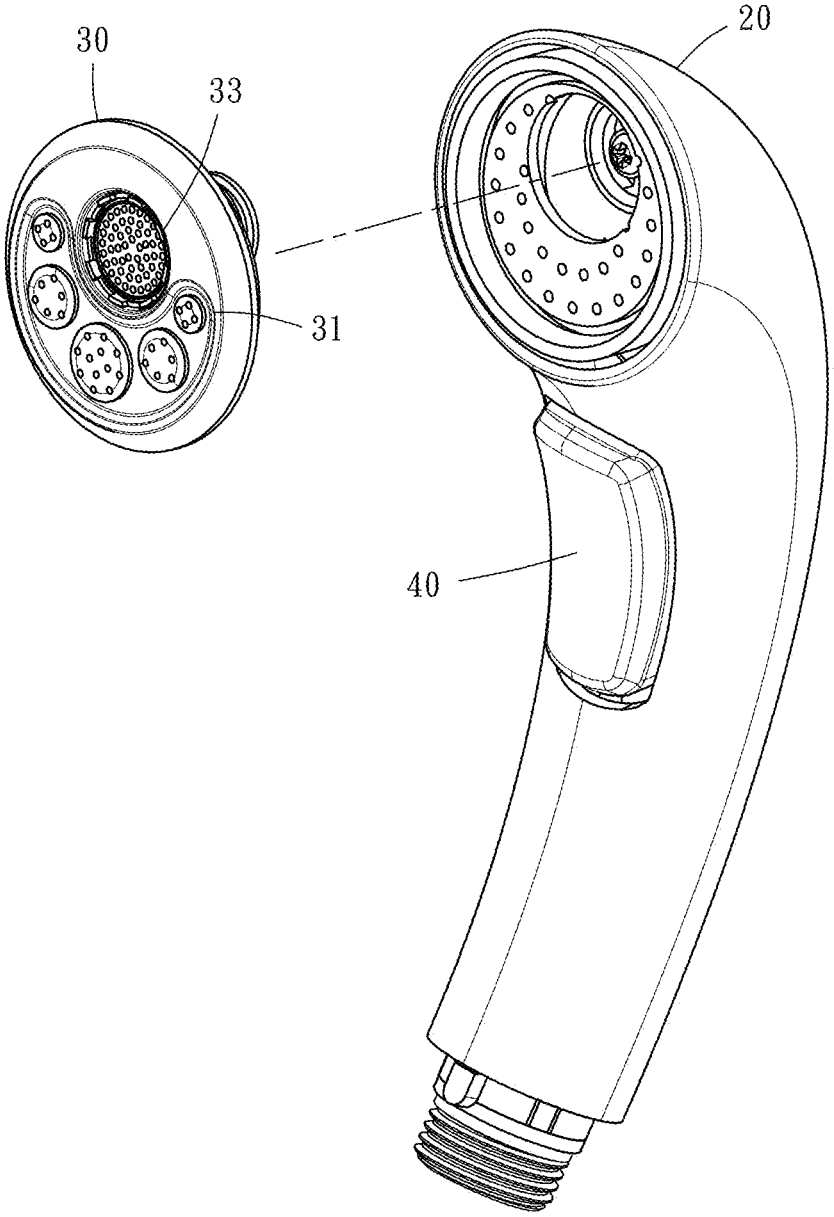
FIG. 2 is an exploded view of the shower head in accordance with the first embodiment of the present invention.
Figure 3:
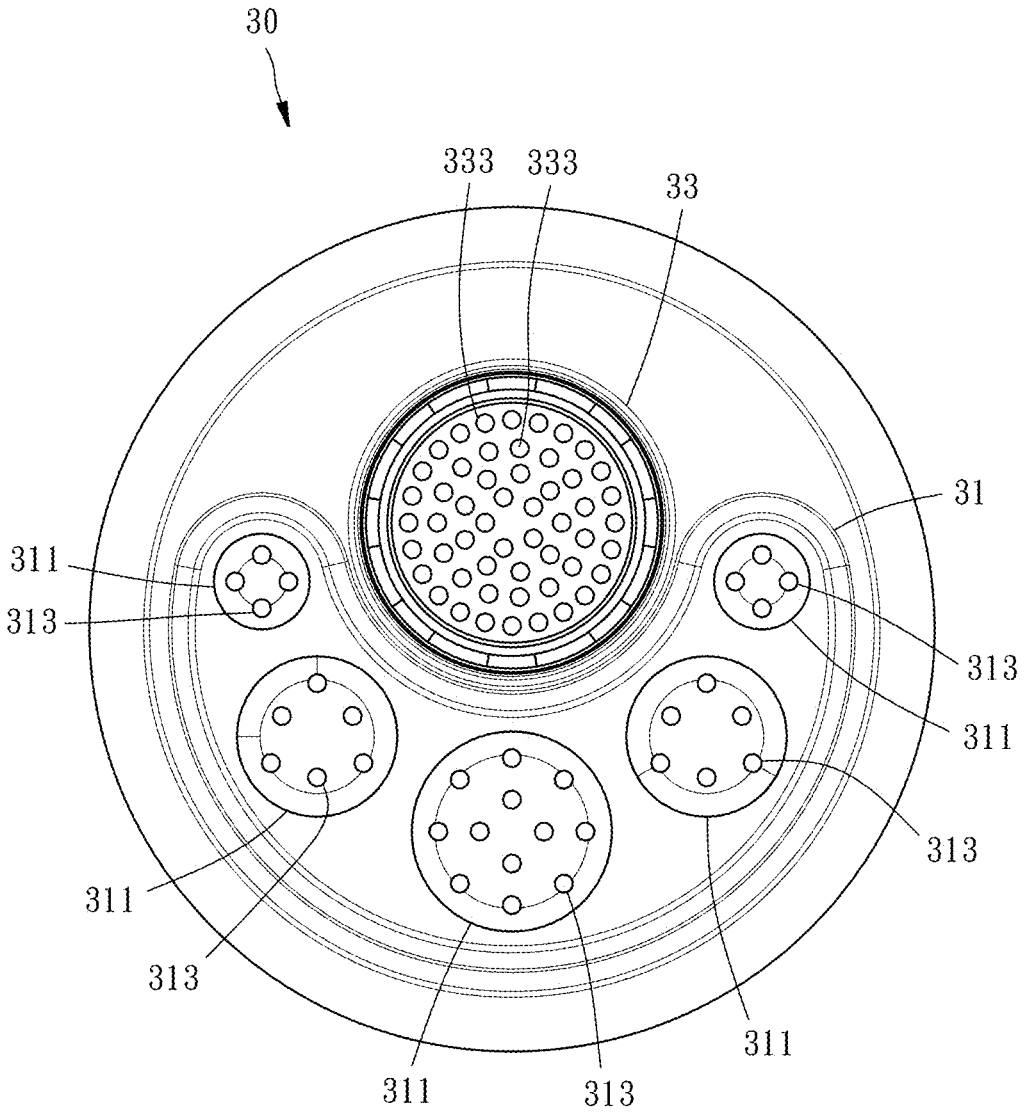
FIG. 3 is a schematic applied view of a part of the shower head in accordance with the first embodiment of the present invention.

Referring to FIGS. 1-3, a shower head 10 in accordance with a first embodiment of the present invention is shown. The shower head 10 comprises a housing 20, a jet faceplate 30, and a switching device 40. The jet faceplate 30 is mounted to one end of the housing 20. The switching device 40 is mounted on the periphery of the housing 20. The housing 20 is the main body of the shower head with the opposite end thereof configured for the connection of a shower tube (not shown) or a water outlet of a water faucet (not shown). The switching device 40 is pressable to control the water jetting mode of the jet faceplate 30.

The jet faceplate 30 is divided into a first water jetting area 31 and a second water jetting area 33. The first water jetting area 31 is composed of multiple subunits 311. Each subunit 311 is formed by a plurality of distributed first jet holes 313. Preferably, the aperture of the equal and plurally distributed first jet holes 313 is between 0.8 mm and 1.0 mm.

The second water jetting area 33 is provided with a second jet hole 333. When the user presses the switching device 40, the original water flowing out from the first water jetting area 31 is switched to flow out from the second water jetting area 31.

Figure 4:
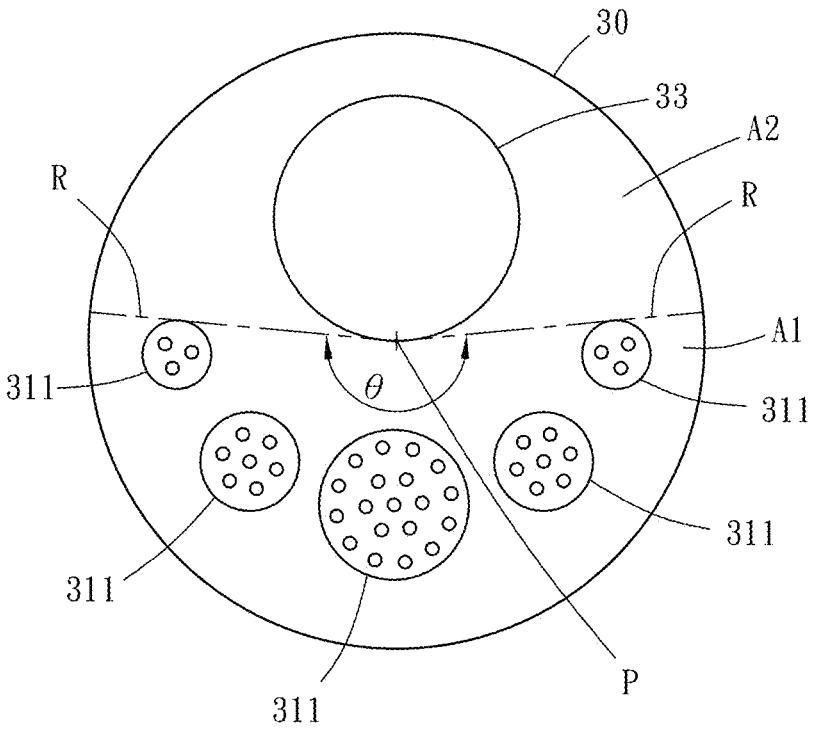
FIG. 4 is another schematic applied view of a part of the shower head in accordance with the first embodiment of the present invention.
Figure 5:
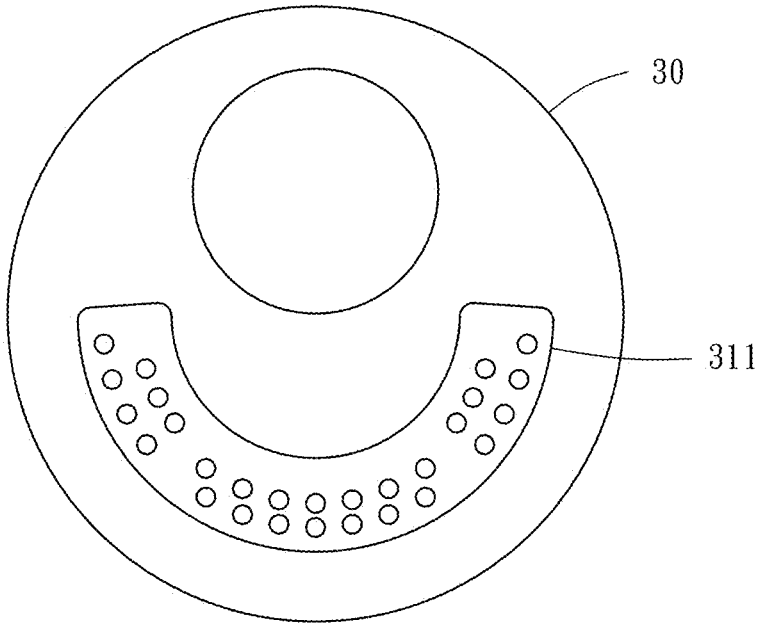
FIG. 5 is still another schematic applied view of a part of the shower head in accordance with the first embodiment of the present invention.
Figure 6:
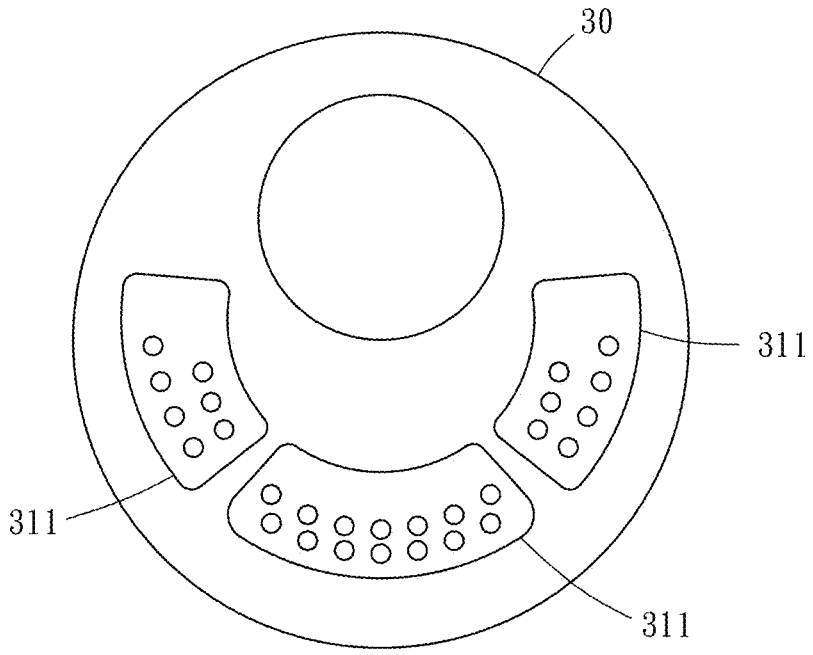
FIG. 6 is still another schematic applied view of a part of the shower head in accordance with the present invention.

It is worth mentioning that, as shown in FIGS. 4-6, based on the fact that the jet faceplate 30 is a circle and based on the unit area thereof, an imaginary center P is set. The imaginary center point P of the jet faceplate 30 is a reference point and each extends to the periphery of the jet faceplate 30 to form two imaginary radii R, thereby allowing the jet faceplate 30 to be divided into two fan-shaped regions, namely, the first fan-shaped region A1 and the second fan-shaped region A2. The subunits 311 of the first water jetting area 31 are arranged in the first fan-shaped region A1 of the jet faceplate 30 to present an arc-shaped distribution. Preferably, the included angle θ of the first fan-shaped region A1 formed using the imaginary center P of the jet faceplate 30 as a reference point and the two imaginary radii R is between 90° and 270°. The second water jetting area 33 is located in the second fan-shaped region A2 of the jet faceplate 30. Preferably, the center of the second jet hole 333 of the second water jetting area 33 is located at the center of gravity of the second fan-shaped region A2 of the jet faceplate 30.

Figure 7:
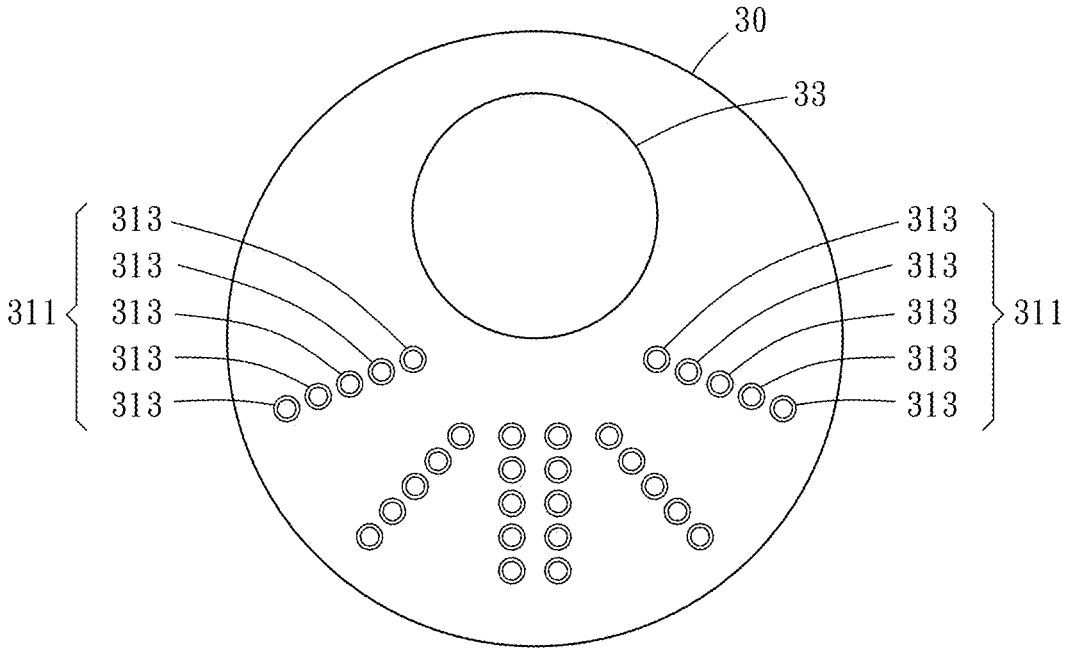
FIG. 7 is a schematic front view of a part of the shower head in accordance with the first embodiment of the present invention.
Figure 8:
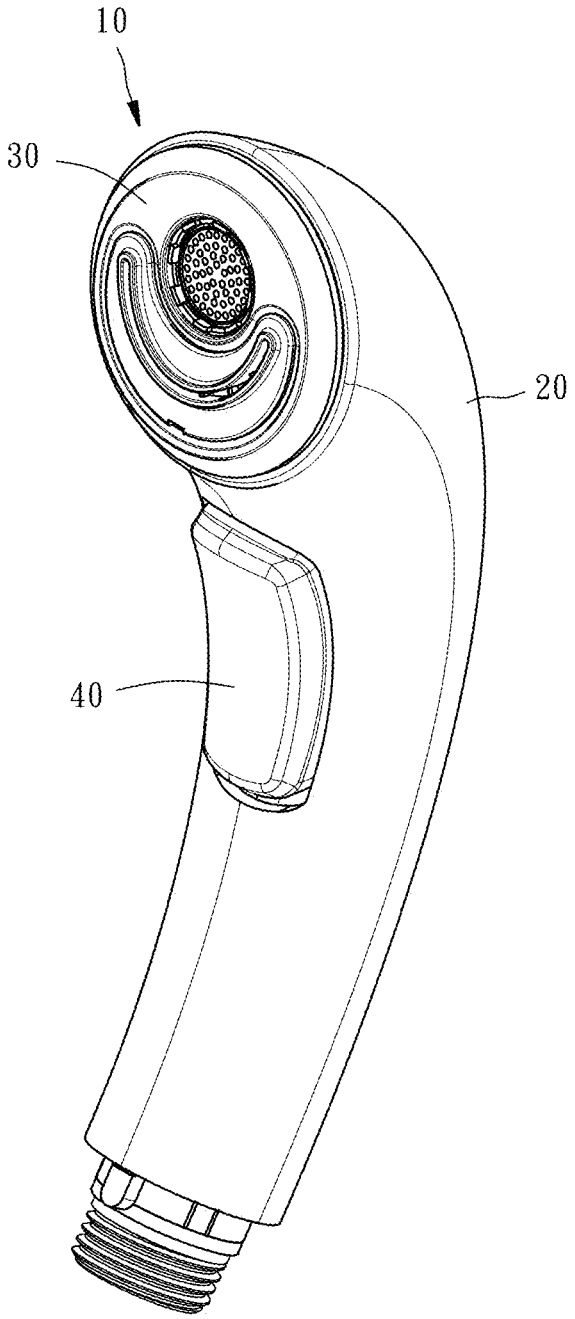
FIG. 8 is schematic elevational view of a shower head in accordance with a second embodiment of the present invention.

It is worth mentioning that, as shown in FIG. 7, the jet faceplate 30 can also be an ellipse or a polygon; the plurality of first jet holes 313 of any of the subunits 311 may be arranged in a radial arrangement or in a straight line; the second water jetting area 33 can be configured to provide a plurality of distributed second jet holes 333.

According to the shower head 10 disclosed in the preceding embodiments of the present invention, the desired effects are as follows:

1. Since the equal and complexly distributed subunits 311 of the jet faceplate 30 of the shower head 10 are in one of the fan-shaped areas divided by the jet faceplate 30 to form the first water jetting area 31 of the jet faceplate 30, when pressing the switching device 40 to switch to the first water jetting area 31, the water line of the ejected water can be concentrated and fan-shaped. In this case, if compared to the "bundled fine water shower structure" in the China Patent Publication No. CN106269323 A, the water line with a fan shape in accordance with the present invention can be more prominently displayed for effectively removing dirt.
2. Since the subunits 311 of the first water jetting area 31 are arranged in the first fan-shaped region A1 of the jet faceplate 30 to present an arc-shaped distribution and the included angle θ of the first fan-shaped region A1 formed using the imaginary center P of the jet faceplate 30 as a reference point and the two imaginary radii R is between 90° and 270°, the user can easily prevent splashes when using the shower head 10. It is worth mentioning that the best included angle θ of the first fan-shaped region A1 is 120°.

Figure 9:
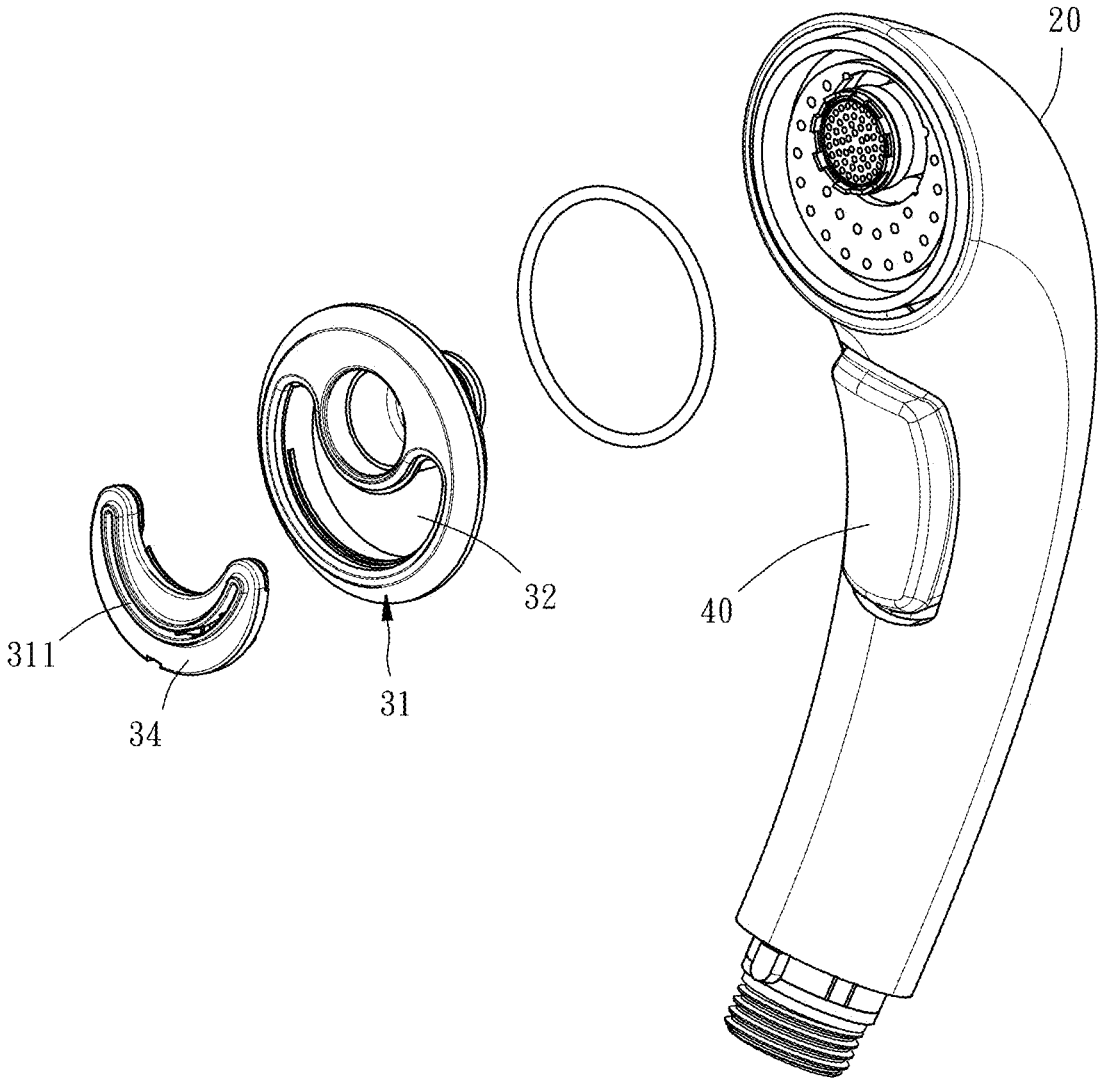
FIG. 9 is an exploded view of the shower head in accordance with the second embodiment of the present invention.
Figure 10:
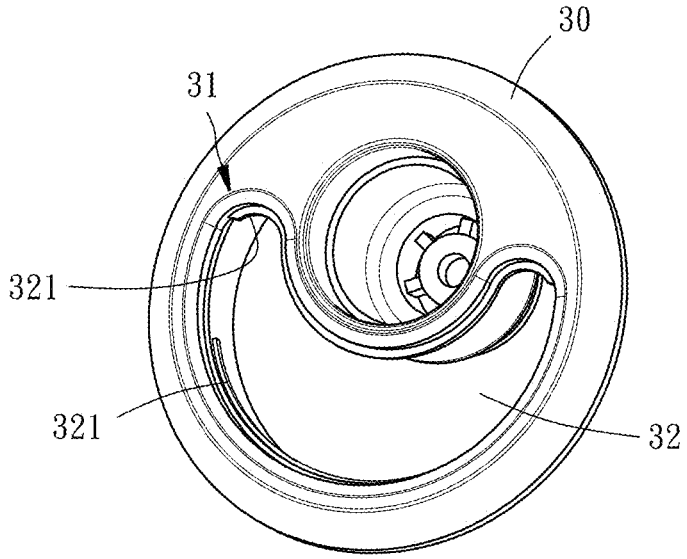
FIG. 10 is a front elevational view of the jet faceplate of the shower head in accordance with the second embodiment of the present invention.
Figure 11:
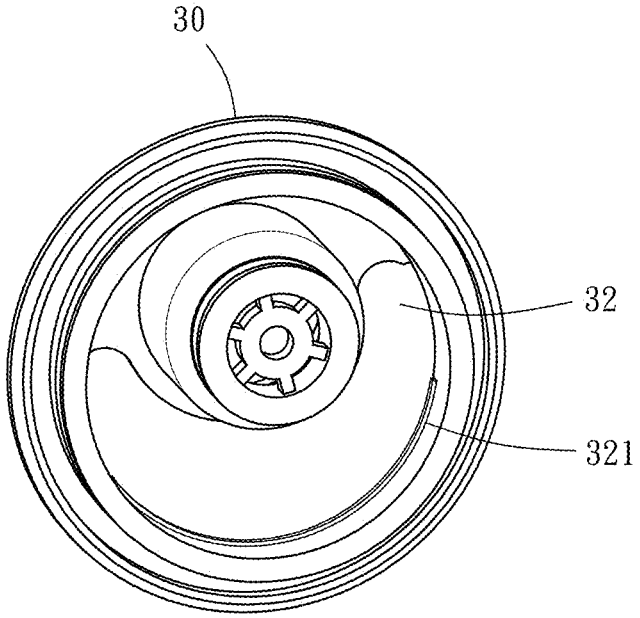
FIG. 11 is a rear elevational view of the jet faceplate of the shower head in accordance with the second embodiment of the present invention.
Figure 12:
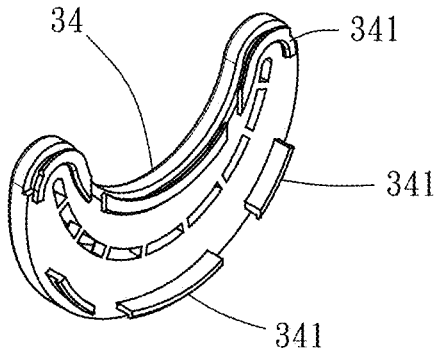
FIG. 12 is a rear elevational view of the insert of the shower head in accordance with the second embodiment of the present invention.
Figure 13:
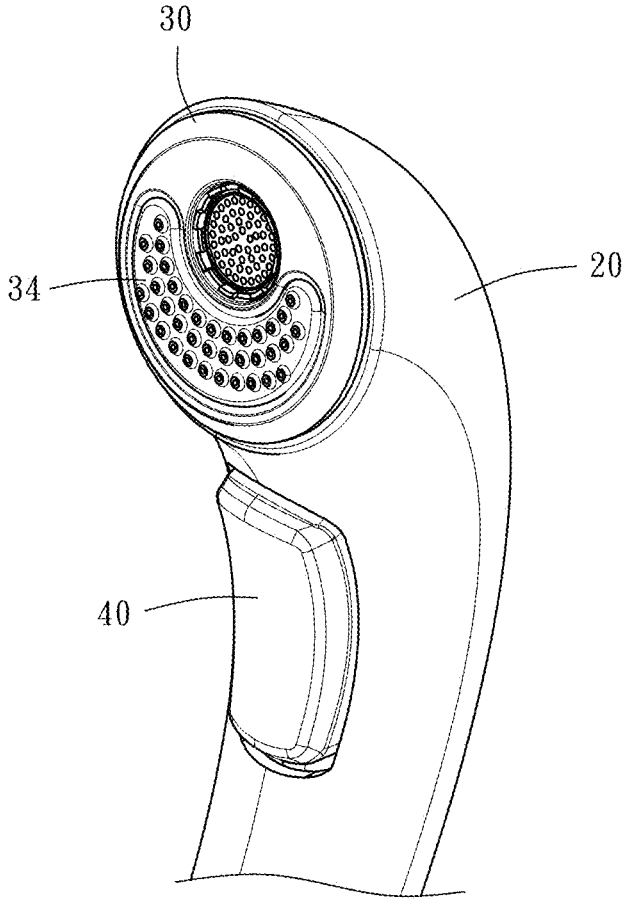
FIG. 13 is a schematic elevational view of the shower head in accordance with the second embodiment of the present invention, showing the insert replaced.
Figure 14:
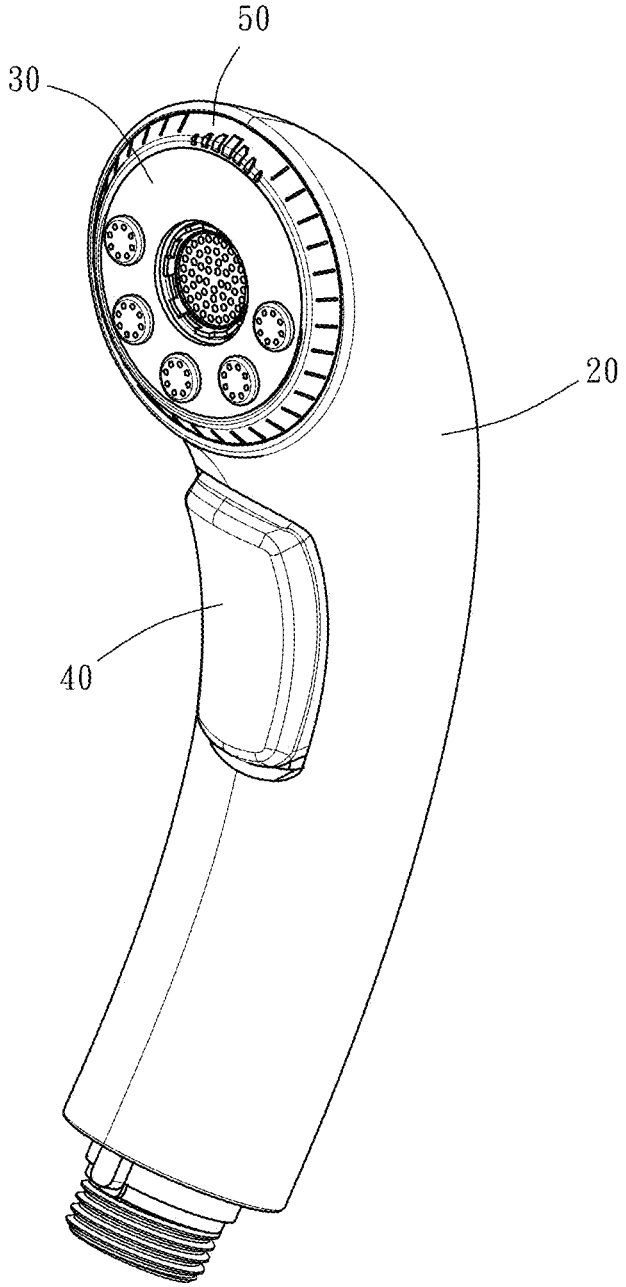
FIG. 14 is a schematic elevational view of a shower head in accordance with a third embodiment of the present invention.
Figure 15:
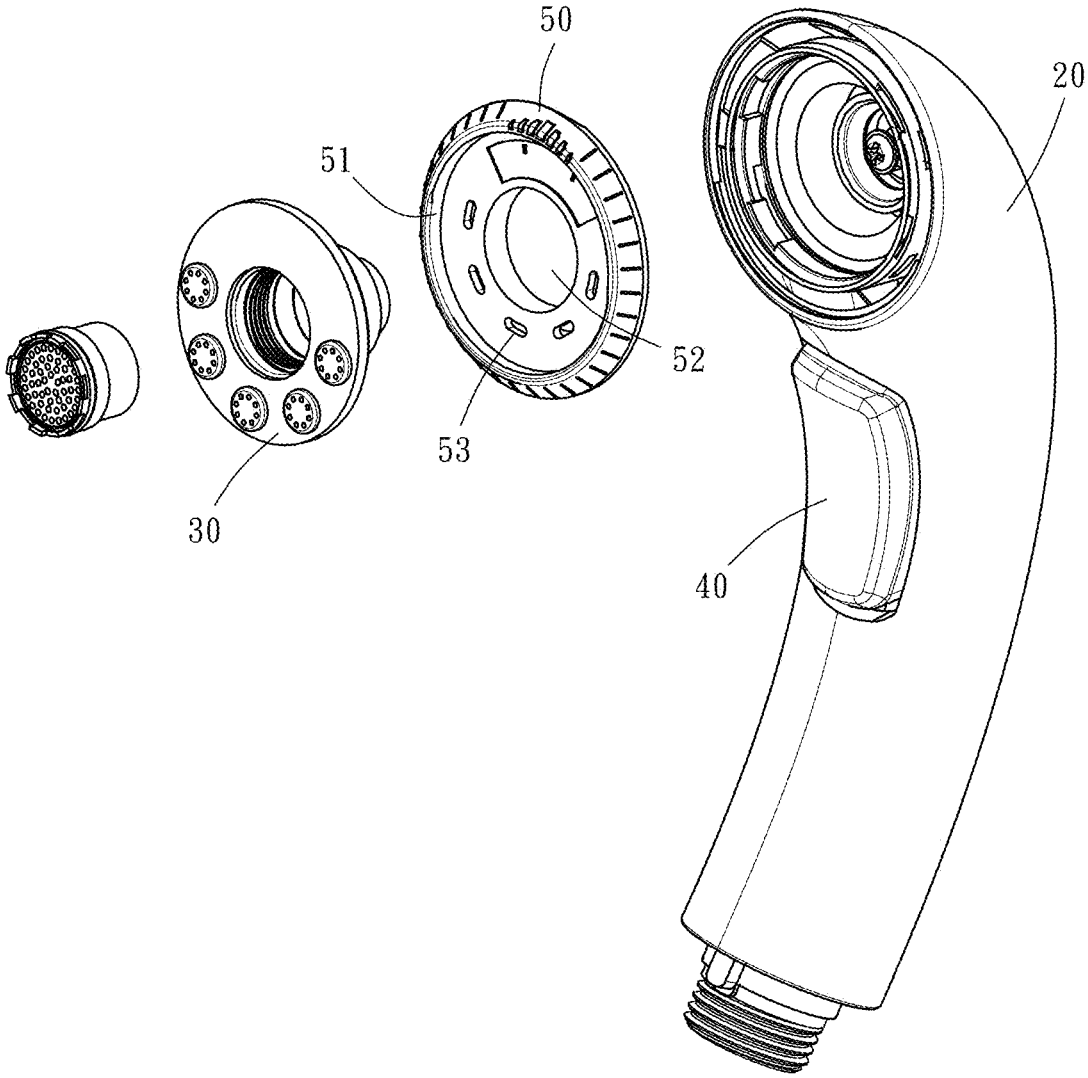
FIG. 15 is an exploded view of the shower head in accordance with the third embodiment of the present invention.

Referring to FIGS. 8-13, a shower head 10 in accordance with a second embodiment of the present invention is shown. The shower head 10 comprises a housing 20, a jet faceplate 30, and a switching device 40. The difference from the aforesaid first embodiment is that the jet faceplate 30 has a fan-shaped recess 32 located in the first water jetting area 31, as shown in FIG. 9, and an insert 34, corresponding to the shape of the fan-shaped recess 32 is mounted in the fan-shaped recess 32. The insert 34 has a plurality of subunits 311 of the first water jetting area 31. The back of the insert 34 is provided with a plurality of convex hook portions 341, and the inner edge wall surface of the fan-shaped recess 32 is provided with a plurality of convex ribs 321. As shown in FIG. 10 and FIG. 11, in this way, the convex hook portions 341 of the insert 34 can be engaged with the convex ribs 321, so that the insert 34 can be fixed with the jet faceplate 30 and can be easily and quickly detached. With the structure of this second embodiment, the user can easily and quickly change the outlet water pattern of the first water jetting area 31 according to his/her own needs. The design of the subunits 311 and the first jet holes 313 with different shapes on the insert 34 provides the user with different choices and feelings in use, as shown in FIG. 13.

Referring to FIGS. 14-18, a shower head 10 in accordance with a third embodiment of the present invention is shown. The shower head 10 comprises a housing 20, a jet faceplate 30, and a switching device 40. The difference from the aforesaid first embodiment is that the housing 20 is mounted with a locating ring 50. The locating ring 50 comprises a circular recess 51, a first through hole 52 located at the center of the circular recess 51, and a plurality of second through holes 53 provided in the circular recess 51 and distributed within the first fan-shaped region A1 in a fan shape with the first through hole 52 as the center. The locating ring 50 further comprises at least one latching protrusion 54 provided on the circular recess 51 and disposed in the second fan-shaped region A2 opposite to the first fan-shaped region A1. In this embodiment, two latching protrusions 54 are provided on the circular recess 51, but not limited to this.

Figure 16:
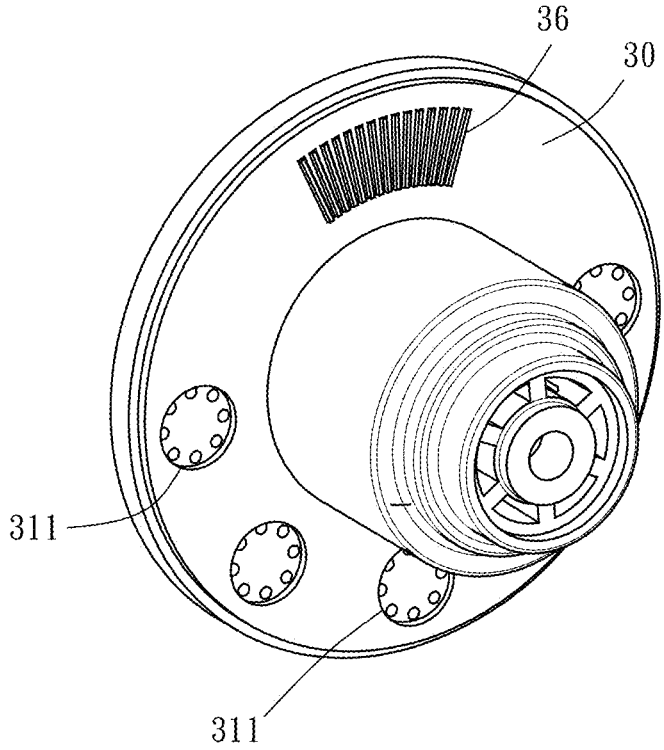
FIG. 16 is a rear elevational view of the jet faceplate of the shower head in accordance with the third embodiment of the present invention.
Figure 17:
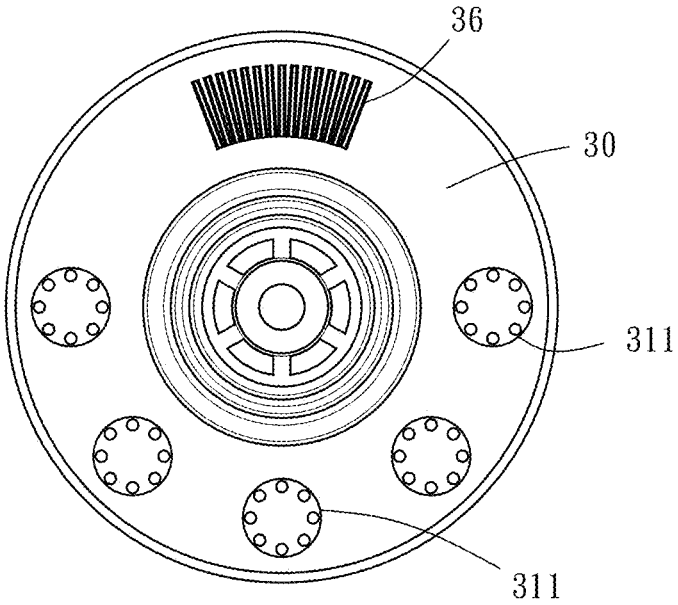
FIG. 17 is a schematic rear side view of the jet faceplate of the shower head in accordance with the third embodiment of the present invention.
Figure 18:
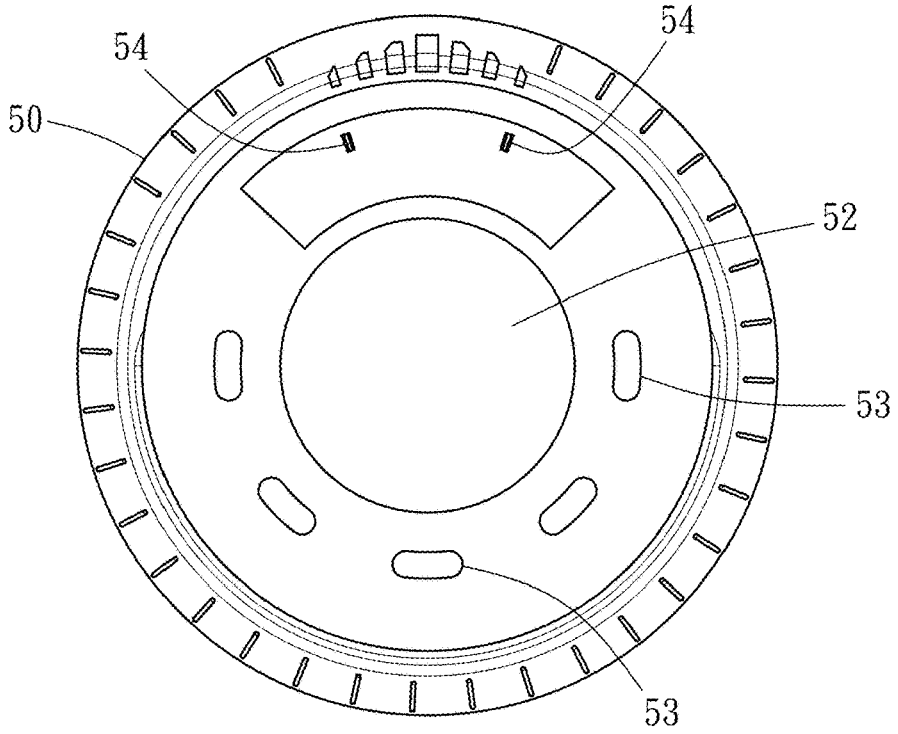
FIG. 18 is a schematic front view of the locating ring of the shower head in accordance with the third embodiment of the present invention.

The jet faceplate 30 is mounted in the circular recess 51 of the locating ring 50 and the locating ring 50 is rotatable relative to the jet faceplate 30. Similarly, the jet faceplate 30 defines a first water jetting area 31 and a second water jetting area 33. The second water jetting area 33 corresponds to the first through hole 52. The first water jetting area 31 comprises a plurality of subunits 311. The number of the subunits 311 corresponds to the number of the second through holes 53. As shown in FIG. 16 and FIG. 17, the jet faceplate 30 has a plurality of convex ribs 36 provided at the back surface thereof corresponding to the latching protrusions 54. The convex ribs 36 are arranged radially with the center of the jet faceplate 30 as the center and distributed in a fan shape.

Figure 19:
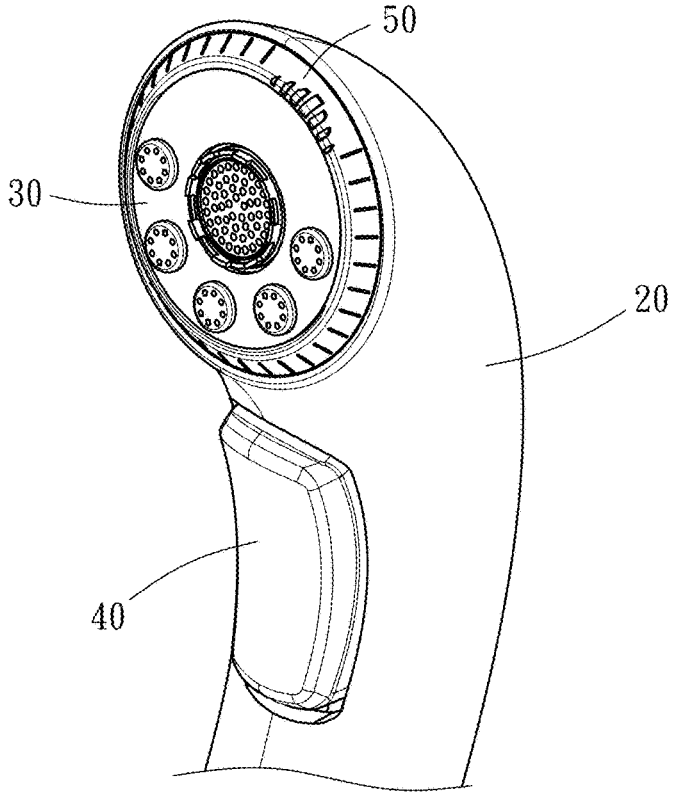
FIG. 19 is a schematic elevational view of the third embodiment of the present invention, showing the jet faceplate angularly adjusted.

With the structure of the third embodiment of the present invention, the locating ring 50 can rotate relative to the jet faceplate 30 and can be locked by engagement between the latching protrusions 54 on the locating ring 50 and the convex ribs 36 on the back of the jet faceplate 30 after turning. The subunits 311 were originally corresponded to the second through holes 53 in one-to-one correspondence, but due to the rotation of the locating ring 50, the subunits 311 are partially blocked, as shown in FIG. 19. In the aspect listed in this embodiment, the first water jetting area originally has 5 subunits. The user can make all 5 subunits correspond to the second through holes, so that all 5 subunits can emit water. Or turn the locating ring so that one of the subunits does not correspond to one respective second through-hole, and only 4 subunits can discharge water. In this way, the user can adjust the water output state of the first water jetting area 31 according to the usage requirements of each person to provide more different use options.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A shower head, comprising:

a housing having one end thereof configured for the connection of a shower tube or a water outlet of a water faucet;

a jet faceplate mounted to an opposite end of said housing, said jet faceplate comprising a first water jetting area composed of a plurality of subunits, and a second water jetting area, wherein each said subunit comprises a plurality of first jet holes, said second water jetting area comprises at least one second jet hole, said second water jetting area is located in a center of said jet faceplate, said subunits of said first water jetting area are located radially outwardly of said second water jetting area arranged in a fan shape;

a locating ring detachably and rotatably mounted on said housing so as to rotate with respect to the jet faceplate, said locating ring comprising a circular recess that accommodates said jet faceplate, wherein said circular recess has a first through hole located at a center of the circular recess, a plurality of second through holes distributed radially outwardly of said first through hole in a fan shape along a first portion of an annular surface of the locating ring, and a plurality of latching protrusions disposed on a second portion of the annular surface of the locating ring opposite the first portion; and wherein the at least one second jet hole is disposed so as to correspond to the first through hole of the circular recess, wherein each of the plurality of subunits is disposed so as to correspond with one of the plurality of second through holes when the locating ring is in a first position, wherein a surface of the jet faceplate facing the annular surface of the locating ring comprises a plurality of convex ribs corresponding to the plurality of latching protrusions, the plurality of convex ribs being arranged radially with respect to a center of the jet faceplate in a fan shape along a first portion of an annular surface of the jet faceplate, wherein the locating ring is configured to rotate relative to the jet faceplate into positions in which fewer than all of the plurality of subunits are aligned with the plurality of second through holes, and wherein said locating ring is configured to be locked in position by engagement between the plurality of convex ribs and the plurality of latching protrusions.

2. The shower head as claimed in claim 1, wherein the number of said subunits of said first water jetting area corresponds to the number of said second through holes.

* * * * *